US009022604B2

(12) United States Patent
Harling et al.

(10) Patent No.: US 9,022,604 B2
(45) Date of Patent: May 5, 2015

(54) ILLUMINATED ATM SURROUND

(75) Inventors: Mark Harling, Salt Lake City, UT (US); David Jay Black, Salt Lake City, UT (US); Alfred Douglas Welch, Salt Lake City, UT (US); Porfirio Andrades, Salt Lake City, UT (US)

(73) Assignee: Sterling ATM, Salt Lake City, UT (US)

( * ) Notice: Subject to any disclaimer, the term of this patent is extended or adjusted under 35 U.S.C. 154(b) by 213 days.

(21) Appl. No.: 13/491,473

(22) Filed: Jun. 7, 2012

(65) Prior Publication Data

US 2013/0329449 A1 Dec. 12, 2013

(51) Int. Cl.
*F21V 99/00* (2006.01)
*G07F 19/00* (2006.01)

(52) U.S. Cl.
CPC ..... *G07F 19/201* (2013.01); *Y10S 362/80* (2013.01)

(58) Field of Classification Search
USPC ..... 362/600–633, 85, 249.01–249.02; 235/379
See application file for complete search history.

(56) References Cited

U.S. PATENT DOCUMENTS

| | | | | |
|---|---|---|---|---|
| 2,722,179 | A | 11/1955 | Belew | |
| D177,721 | S | 5/1956 | Deaton | |
| D210,871 | S | 4/1968 | Payne | |
| D213,676 | S | 4/1969 | Biro | |
| 3,443,345 | A | 5/1969 | Spencer | |
| D223,487 | S | 4/1972 | Brashear | |
| D250,603 | S | 12/1978 | Roesch | |
| D250,604 | S | 12/1978 | Roesch | |
| D292,423 | S | 10/1987 | Williams et al. | |
| D293,151 | S | 12/1987 | Prinzhorn | |
| D293,269 | S | 12/1987 | Prinzhorn | |
| 5,217,088 | A | 6/1993 | Dallman | |
| D368,533 | S | 4/1996 | Wright | |
| D379,233 | S | 5/1997 | Wright | |
| D407,183 | S | 3/1999 | DePietro et al. | |
| D416,626 | S | 11/1999 | Moller et al. | |
| 6,000,806 | A | 12/1999 | Dallman | |
| D423,181 | S | 4/2000 | Dallman | |
| D446,377 | S | 8/2001 | Dallman | |
| D454,210 | S | 3/2002 | Lindgren et al. | |
| D455,889 | S | 4/2002 | Jobin | |
| D460,482 | S | 7/2002 | Nomura | |
| 6,527,172 | B1 * | 3/2003 | Lewis et al. | 235/379 |
| 6,685,086 | B1 | 2/2004 | Mackenzie | |
| D559,406 | S | 1/2008 | Boshell et al. | |
| D559,906 | S | 1/2008 | Sakaguchi | |
| 7,314,161 | B1 * | 1/2008 | Korte et al. | 235/379 |
| D567,393 | S | 4/2008 | Ouellette et al. | |
| D587,463 | S | 3/2009 | Franco et al. | |
| D588,186 | S | 3/2009 | Yamakawa | |
| 7,766,536 | B2 | 8/2010 | Peifer et al. | |
| D625,838 | S | 10/2010 | Walsh et al. | |

(Continued)

FOREIGN PATENT DOCUMENTS

| | | |
|---|---|---|
| DE | 10 2008 017 541 | 8/2009 |
| GB | 2 276 418 | 9/1994 |
| JP | 07-320113 | 12/1995 |

*Primary Examiner* — Stephen F Husar
*Assistant Examiner* — Gerald J Sufleta, II
(74) *Attorney, Agent, or Firm* — Pate Peterson, PLLC; Brett Peterson

(57) ABSTRACT

A low profile illuminated ATM surround is provided. The surround is used with ATMs which are mounted through a wall. The surround is attached to the wall, providing a broad illuminated advertising area around the ATM while maintaining a very low profile, allowing the surround to be used in locations where minimal space is available.

20 Claims, 10 Drawing Sheets

(56) References Cited

U.S. PATENT DOCUMENTS

| | | | | |
|---|---|---|---|---|
| D635,689 | S | 4/2011 | Van Faasen et al. | |
| 8,074,390 | B2 | 12/2011 | Rain | |
| D653,835 | S | 2/2012 | Strempack et al. | |
| D657,417 | S | 4/2012 | Naimi | |
| D691,653 | S | 10/2013 | Benadon et al. | |
| 2006/0157567 | A1* | 7/2006 | Baumann et al. | 235/451 |
| 2011/0090427 | A1* | 4/2011 | Ohue et al. | 349/65 |
| 2011/0090694 | A1 | 4/2011 | Hardacker et al. | |
| 2011/0141358 | A1 | 6/2011 | Hardacker et al. | |
| 2012/0134179 | A1* | 5/2012 | Que | 362/616 |

* cited by examiner

ILLUMINATED ATM SURROUND

THE FIELD OF THE INVENTION

The present invention relates to automated teller machines. More specifically, the present invention relates to surrounds used in installing an ATM.

BACKGROUND

An increasing amount of banking is done without utilizing a bank teller. Many transactions are performed outside of the bank itself and without interacting with a bank employee. Automated teller machines, or ATMs are increasingly used to handle banking transactions such as cash withdrawal as they are convenient and often faster than using a bank teller or drive through window.

As ATMs are used for a higher fraction of a bank's transactions, they become an increasingly important part of the bank's branding and customer image. Banks have made attempts to distinguish their ATMs from other banks' ATMs so that their customers can quickly recognize their own banks ATMs. ATMs have thus become an important advertising venue and an important trademark and branding element.

To make their ATMs easily recognizable, banks often integrate their logo onto or around the ATM itself and also use signs and other devices with the ATM to draw the attention of customers. There is a need to make ATMs more easily recognized by customers, more user friendly to customers, and to otherwise increase the attractiveness and visibility of the ATM.

SUMMARY OF THE INVENTION

It is an object of the present invention to provide an improved surround for through-the-wall ATMs.

According to one aspect of the invention, an ATM surround is provided which extends around the customer interface of a through-the-wall ATM. The ATM surround is typically mounted to the wall and the customer interface of the ATM extends through an opening in the surround. According to another aspect of the invention, an illuminated flat panel ATM surround is provided. The ATM surround provides a flat area which is presented to people around the ATM and which provides a broad illuminated area usable for advertising, images, graphics or logos.

These and other aspects of the present invention are realized in an illuminated ATM surround as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
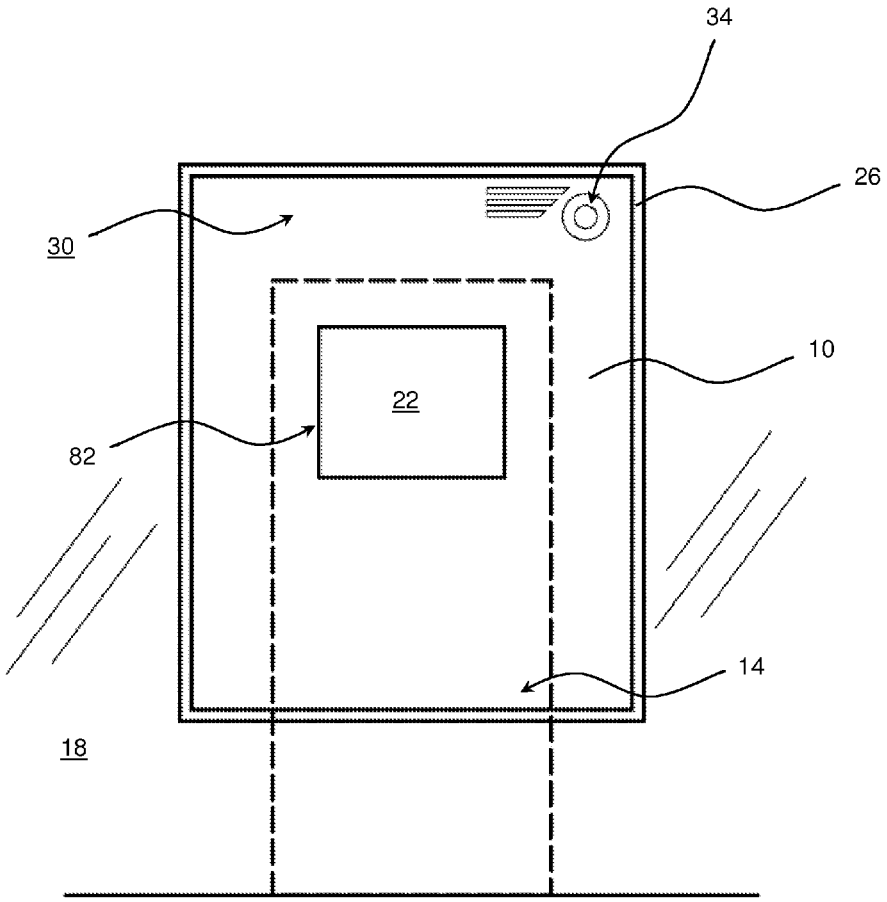
FIG. 1 shows a front view of an installed ATM surround according to the present invention.

Turning now to FIG. 1, a front view of an installed ATM surround according to the present invention is shown. The surround 10 is installed in combination with an ATM 14 that is mounted through a wall 18. The ATM 14 is typically installed inside of a building so that the ATM itself is in a secure environment. The ATM customer interface 22 extends through the wall and through the surround 10 so as to be accessible to a customer. A small bezel is typically used around the customer interface 22 and the corresponding opening 82 in the surround. The wall 18 may be an exterior wall, placing the ATM itself in a secure part of a bank or other building. In this situation, the customer interface 22 will extend through the wall and be accessible outside of the building. The wall 18 may also be an interior wall, placing the customer interface 22 in a building lobby.

Figure 2:
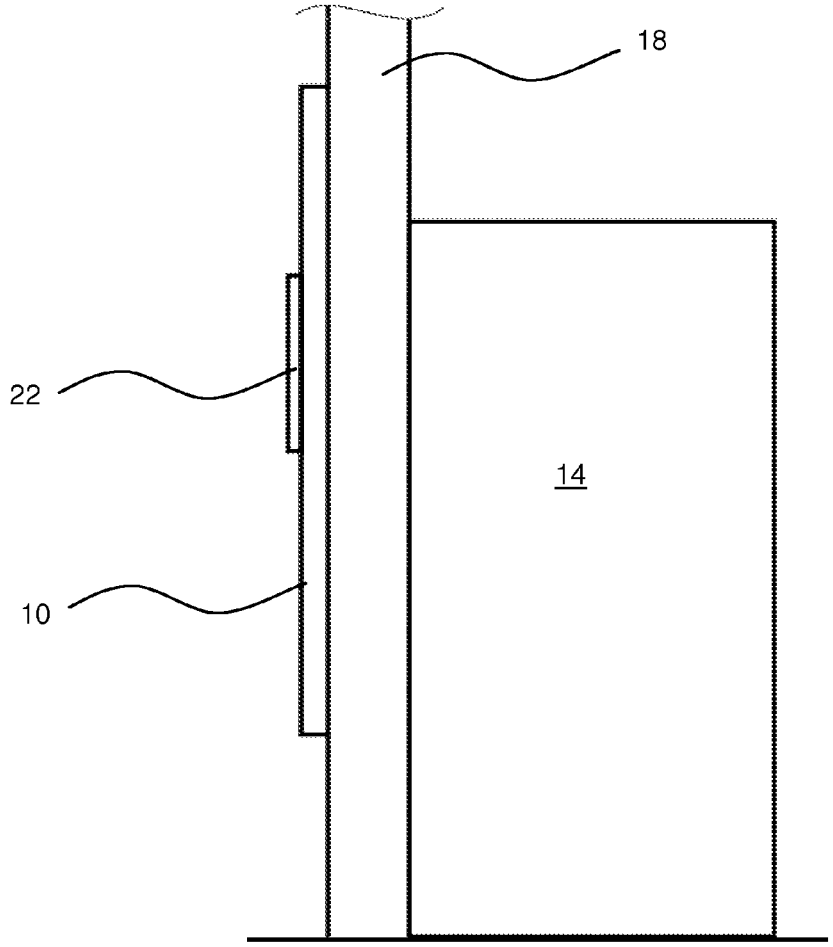
FIG. 2 shows a side view of the installed ATM surround of FIG. 1.

FIG. 2 shows a side view of the ATM surround of FIG. 1. It can be seen how the ATM 14 is mounted on one side of the wall 18 as well as how the customer interface 22 extends through the wall 18 and through the surround 10. In a typical installation, the surround 10 and the ATM customer interface 22 are the only parts which are visible to a customer.

As is visible in FIG. 1, the surround 10 includes a frame 26 and an illuminated field 30. The illuminated field 30 is backlit so that the entire field 30 is illuminated. The field area 30 is typically used to display a graphic element 34. The graphic element 34 may be a picture, logo, color, etc. and may often fill the entire illuminated field area 30. A bank will often use the illuminated field area 30 to display their own name or logo so that customers can easily recognize the ATM.

The surround 10 provides an area which is much larger than the customer interface 22. Typical surrounds 10 may be about 4 feet wide and about 6 or 8 feet tall while the customer interface 22 is often about 20 inches wide and tall. As such, the illuminated field area 30 provides a large area around the customer interface 22. The illuminated field area 30 may be a foot wide or more on the sides of the ATM and may provide several feet above and/or below the ATM. As such, the field area 30 provides a large area for displaying a graphic, name, or logo and, since it is illuminated, provides high visibility for the ATM.

FIG. 2 shows how the surround 10 is very low profile and does not extend far from the wall 18. The surround 10 is mounted to the wall so that the surround and the illuminated field 30 are parallel to the wall. Typically, the surround may be about 2.5 inches thick or less. The surround may often be between about 2.5 inches thick and about 1.375 inches thick. This provides several benefits. The surround 10 allows for easy access to the ATM, particularly for handicapped people, as the surround does not extend further than the customer interface in most installations. This provides room below the customer interface and does not interfere with placing a wheelchair close to the ATM. Because the surround 10 is thin, the surround minimizes any intrusion into a sidewalk or lobby where the ATM is accessed. This makes it easier to install an ATM and surround where space is limited. Additionally, the thin surround 10 provides a very clean and modern appearance, making the ATM more visually appealing.

Figure 3:
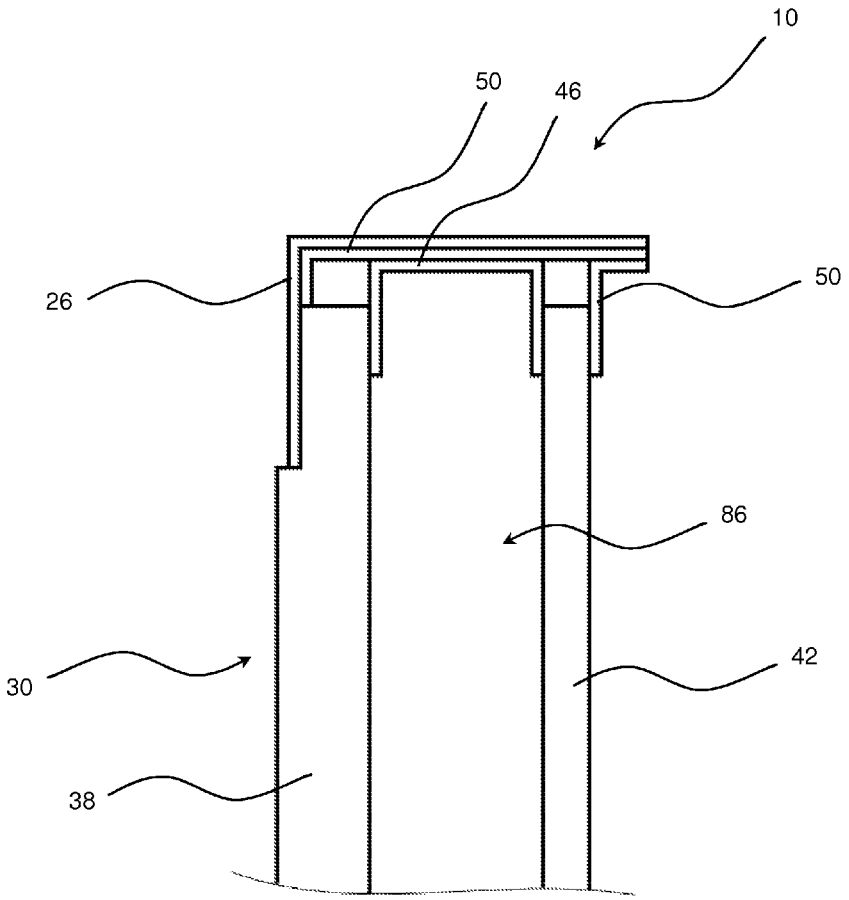
FIG. 3 shows a cross sectional view of the ATM surround of FIG. 1.

FIG. 3 shows a cross sectional view of a portion of the ATM surround of FIG. 1. The surround 10 includes a frame 26 and an illuminated field area 30. A partial cross sectional view of the top of an ATM surround is shown. As such, the left side of the surround 10 would face outwardly from the wall 18 and be visible to customers. The right side of the surround 10 would be placed against the wall 18. The illuminated field area 30 is formed by several elements. Typically, the surround 10 includes a front panel 38 which is made of acrylic sheet or a similar material. An LED illumination panel 42 is held behind the front panel 38. The LED panel 42 projects light forward and the light passes through the front panel 38, illuminating the front panel and any graphic element 34 which is applied to the front panel. The surround 10 typically includes a spacer element 46 which maintains a predetermined space between the front panel 38 and the LED panel 42. Additionally one or more clamp elements 50 are used to hold the front panel 38, LED panel 42, spacer element 46, and frame 26 together. Fasteners, adhesive, welding, etc. may be used to attach the frame 26, clamp elements 50, and spacer element 46 together as necessary.

Figure 4:
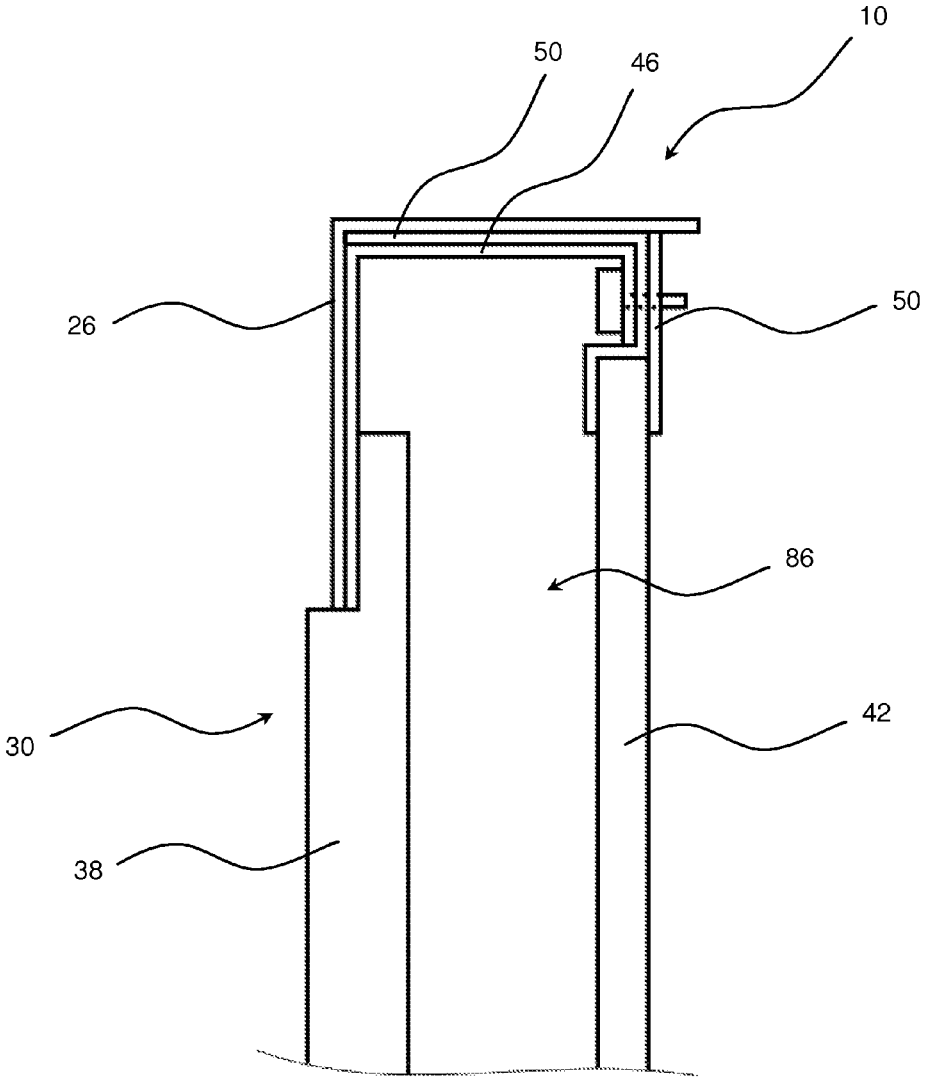
FIG. 4 shows an alternate cross sectional view of the ATM surround of FIG. 1.

FIG. 4 shows an alternate cross sectional view of the ATM surround of FIG. 1. The surround shown in FIG. 4 is similar to that shown in FIG. 3 and differs in the fastening elements 50 and spacer element 46 used to secure the front panel 38 and the LED panel 42 to the frame 26. The front panel 38 and LED panel 42 of FIG. 4 are similar to those of FIG. 3. As has been discussed, the LED panel 42 projects light forward from the front face of the LED panel. Although not necessary in all applications, the front panel 38 is often spaced apart from the LED panel by a small distance in order to manage heat from the LED panel and to ensure even lighting of the front panel 38.

Figure 5:
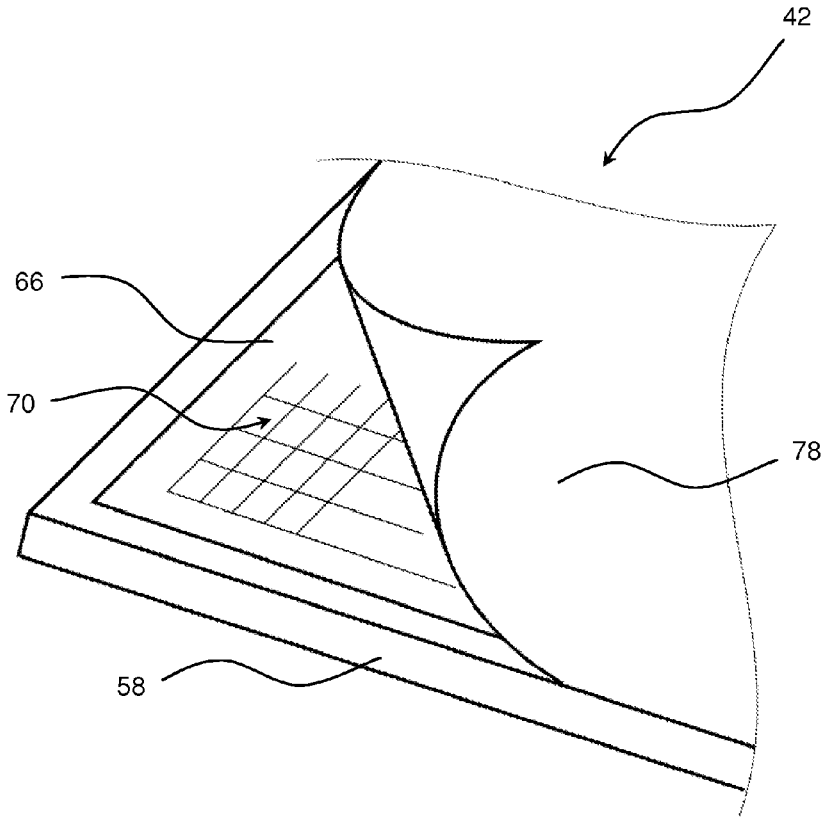
FIG. 5 shows a perspective view of an LED panel for the ATM surround of FIG. 1.
Figure 6:
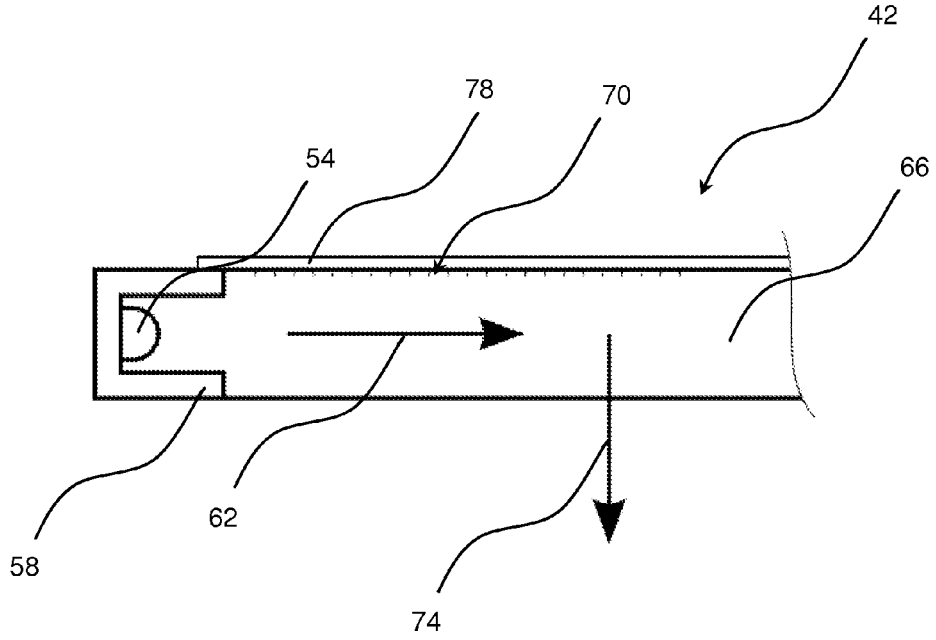
FIG. 6 shows a cross sectional view of the LED panel of FIG. 5.

FIG. 5 shows a perspective view of an LED panel for the ATM surround of FIG. 1. FIG. 6 shows a cross sectional view of the LED panel of FIG. 5. The LED panel 42 includes a plurality of LEDs 54 mounted around the peripheral edges of an acrylic panel 66. A heat sink 58, such as an aluminum channel, encloses the edge of the panel 42 and is mounted against the LEDs 54 to conduct heat away from the LEDs. Typically, a square or rectangular panel 42 is used. The LEDs 54 and heat sink 58 extend around all four edges of the panel 54.

The LEDs 54 emit light into the edge of the panel in a direction parallel to the panel, as indicated by arrow 62. The back surface of the acrylic panel 66 has a grid of small grooves 70 which are cut, etched, or otherwise formed in the acrylic panel. These grooves 70 reflect the light from the LEDs forwards and out of the acrylic panel 66 as shown by arrow 74. A reflective white film 78 is placed over the back surface of the acrylic panel 66, covering the grooves 70. Between the grooves 70 and the film 78, nearly all of the light emitted from the LEDs 54 is projected forwards out of the LED panel 42.

Figure 7A:
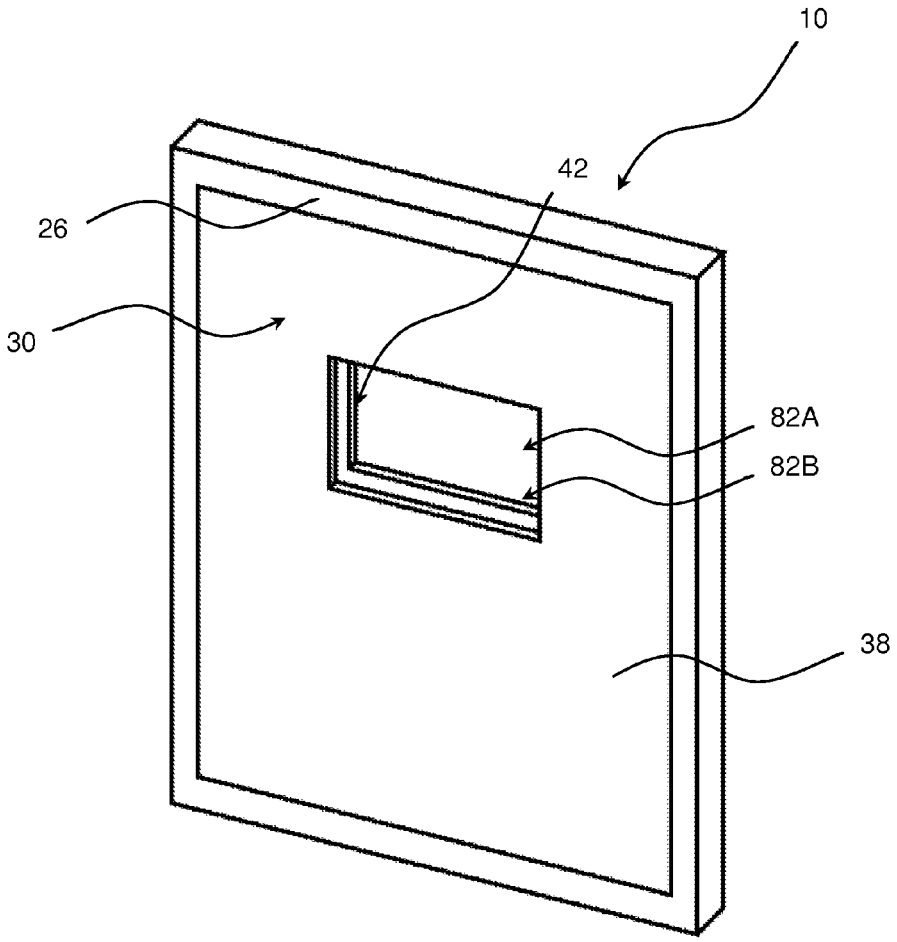
FIG. 7A shows a perspective view of an ATM surround of the present invention.

FIG. 7A shows a perspective view of an ATM surround of the present invention. The ATM surround 10 has been prepared for installation around the customer interface 22 of an ATM 14. As such, a first opening 82A has been cut into the front panel 38 and a second opening 82B has been cut into the LED panel 42. Even though the LEDs 54 shine light inwardly towards the opening 82, the LED panel 42 of the present invention still directs nearly all of the light forward and out the front face of the LED panel 42 and very little light is emitted through the opening 82. Nearly all of the light is directed forwards through the illuminated field area 30. The light is evenly emitted from the front of the LED panel 42, providing even illumination for the front panel 38.

As has been discussed, the front panel 38 and associated structures are typically chosen to provide a branding and advertising benefit, such as displaying a bank name or logo. As the front panel 38 is typically chosen to provide a branding element, it is often selected to include a desired color or type of plastic and often includes printing, painting, or vinyl to display a desired graphic. The front panel 38 may include vinyl, printing, or painting on its front or back surface to present a graphic image to a user. This may be achieved through the use of different color and image patterns as well as selectively blocking light through the use of opaque paint or vinyl.

Figure 7B:
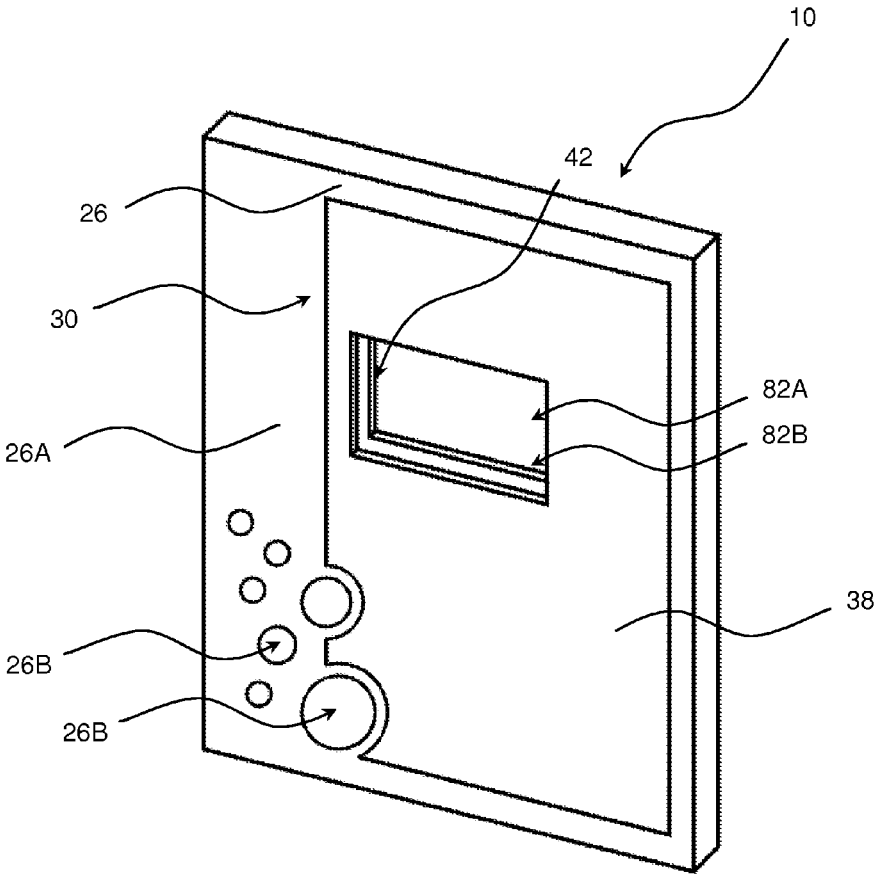
FIG. 7B shows a perspective view of an ATM surround of the present invention.

FIG. 7B shows an alternate perspective view of the surround shown in FIG. 7A. The frame 26 includes a metal panel 26A which extends inwardly from the left side of the frame, covering a portion of the front panel 38. The metal panel 26A may include cut out portions as indicated at 26B. The metal panel 26A will block light from passing through and allow light to pass through the cut out portions 26B, providing an additional visual element to increase the attractiveness of the surround 10. Such a metal panel 26A may be used to present a name or logo as well as different decorative patterns.

Figure 8:
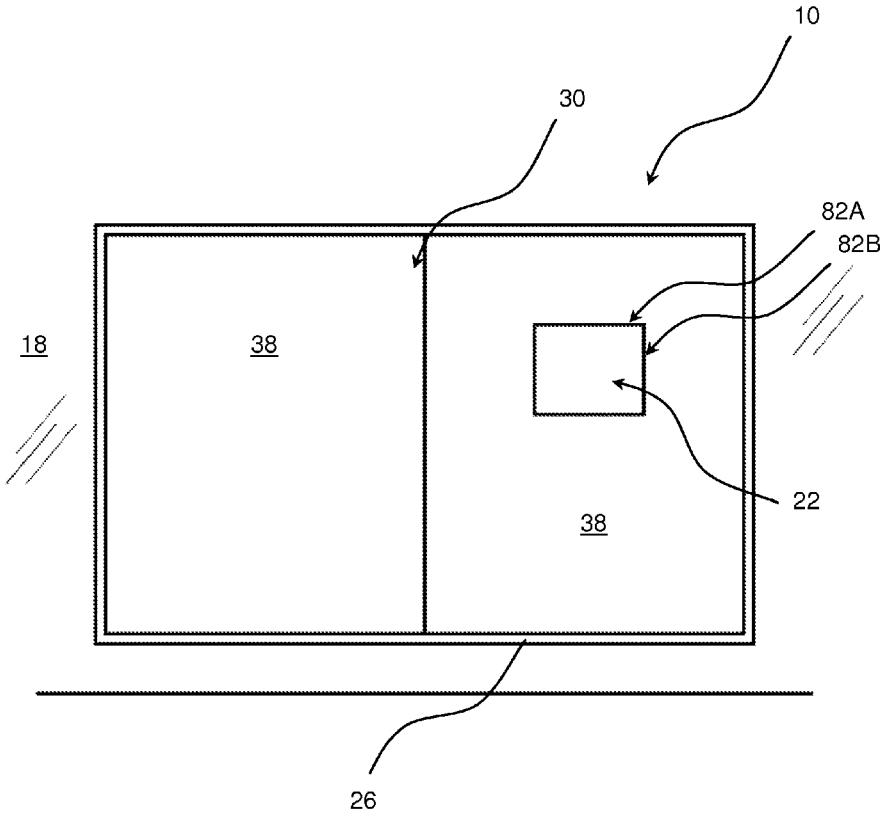
FIG. 8 shows another front view of an installed ATM surround of the present invention.

FIG. 8 shows another front view of an installed ATM surround of the present invention. The ATM surround 10 is similar to those discussed above and contains the same features and benefits unless otherwise noted. The surround 10 differs primarily in that it is wider, necessitating the use of two front panels 38 placed next to each other. More importantly, the surround 10 necessitates the use of two LED panels 42 placed next to each other.

Figure 9:
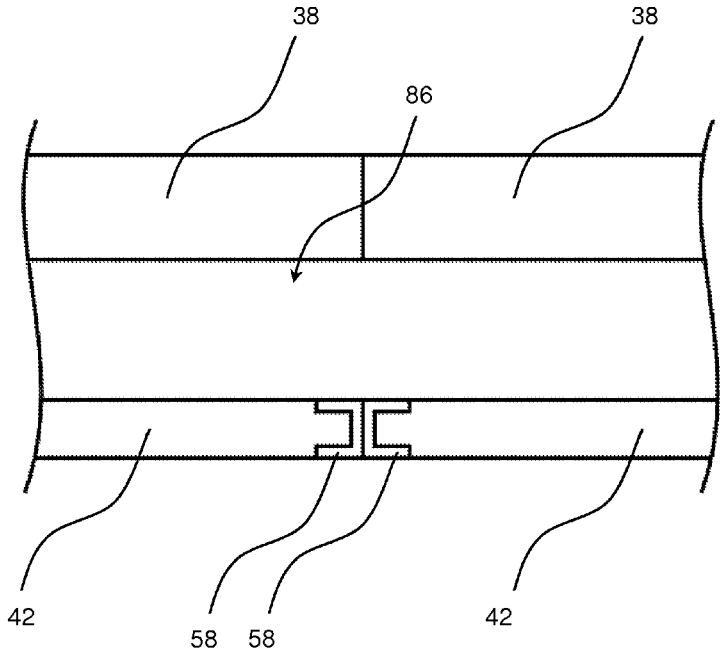
FIG. 9 shows a cross section of the surround of FIG. 8.

FIG. 9 shows a cross section of the surround of FIG. 8, taken through the center of the surround 10 adjacent the joint between the two adjacent LED panels 42 and front panels 38. Of particular interest, the adjacent LED panels 42 result in two adjacent heat sinks 58 located at the joint between the LED panels. In a surround with a single LED panel 42, the heat sinks 58 are disposed around the edges of the front panel 38 and typically covered by the frame 26. Here, the heat sinks 58 are disposed in the center of the illuminated field area 30 where uneven illumination would interfere with a graphic displayed thereon.

Because of the adjacent heat sinks 58, a space 86 between the LED panel 42 and the front panel 38 is used to create even illumination. It has been determined that a space of about 1 inch is sufficient for even illumination of the front panel 38. The space between the front panel 38 and the LED panel 42 may be adjusted for the requirements of the particular ATM surround 10. Where a single LED panel 42 is used, the front panel 38 may be very close to the LED panel and still achieve even illumination of the front panel. Different materials which are used for the front panel 38 may necessitate changes in the space 86. If the front panel is frosted, a smaller space 86 may be sufficient. If the front panel is transparent or translucent color, more space 86 may be necessary. Where two adjacent LED panels 42 are used, more space 86 may be necessary for even lighting. Typically, a space 86 of between about 0.5 and about 1.5 inches is used where two adjacent LED panels 42 are used. More particularly, this space 86 may be between about 1 and about 1.25 inches. Where a single LED panel 42 is used, the space 86 may be between 0 and about 1.5 inches, and more particularly between about 0.25 and about 1 inch while achieving even illumination.

Even with the space 86, the ATM surround 10 is quite thin. The surround 10 is often between about 1.5 and 2.5 inches thick. This provides for an attractive installation that does not take a considerable amount of space. Thus, the surround 10 may be used in a lobby or sidewalk area where minimal space is available. The surround 10 provides good accessibility to the ATM and does not hinder access for persons in a wheelchair.

The ATM surround 10 is also beneficial for advertising as it provides a large illuminated area 30 which can completely surround the ATM customer interface 22 as desired. This provides a large uninterrupted space where desired advertising graphics can be displayed.

There is thus disclosed an improved ATM surround. It will be appreciated that numerous changes may be made to the present invention without departing from the scope of the claims.

What is claimed is:

1. An illuminated ATM surround system with an ATM, the ATM being mounted adjacent a wall in a first location and having a customer interface extending through the wall to provide customer access to the ATM in a second location, the surround comprising:

a front panel which is translucent or transparent and allows light to pass through the panel material;

an LED illumination panel disposed behind the front panel;

a frame mounted around outer edges of the front panel and the LED illumination panel so as to enclose the outer edges of the front panel and the LED illumination panel;

a spacer element disposed between the front panel and the LED illumination panel to define a space between the front panel and the LED illumination panel;

a first opening formed in the front panel;

a second opening formed in the LED illumination panel, the second opening having a shape and location corresponding to the first opening; and wherein the surround is mounted to a wall such that the LED illumination panel is disposed between the wall and the front panel;

wherein an ATM customer interface extends through the wall, through the first opening in the front panel, and through the second opening in the LED illumination panel, the ATM customer interface allowing a person to complete banking transactions and withdraw cash from an ATM; and wherein the LED illumination panel projects light through the front panel material to define an illuminated area.

2. The surround of claim 1, wherein the LED illumination panel comprises LEDs mounted around the outer edges of the LED illumination panel, wherein the LEDs project light into the outer edges of the LED illumination panel towards the center of the LED illumination panel, and wherein the LED illumination panel projects the light forward out the front face of the LED illumination panel.

3. The surround of claim 1, wherein the surround has a thickness of between about 1.375 inches and about 2.5 inches.

4. The surround of claim 1, wherein the space between the front panel and the LED illumination panel is between about 0 and about 1.5 inches.

5. The surround of claim 1, further comprising a graphic applied to the front panel.

6. The surround of claim 2, wherein the LED illumination panel comprises grooves formed in the back of the panel.

7. The surround of claim 6, further comprising a reflective film attached to the back of the panel.

8. The surround of claim 2, wherein substantially all of the light from the LEDs is emitted from a front face of the LED illumination panel.

9. The surround of claim 1, wherein the surround comprises a first LED illumination panel and a second LED illumination panel disposed adjacent each other, wherein adjacent edges of the first LED illumination panel and the second LED illumination panel comprise heat sinks such that an area is formed along the adjacent edges of the first LED illumination panel and the second LED illumination panel which is not illuminated.

10. The surround of claim 9, wherein the space between the LED illumination panel and the front panel is between 0.5 and 1.5 inches.

11. The surround of claim 1, wherein the front panel and the LED illumination panel extend continuously around an outside of the customer interface.

12. An illuminated ATM surround system comprising:

a front panel which is formed from a translucent or transparent material which allows light to pass therethrough;

an LED illumination panel disposed behind the front panel, the LED illumination panel having a size and shape which are approximately the same as a size and shape of the front panel;

a frame extending around the outer edges of the front panel and the LED illumination panel;

wherein the LED illumination panel is illuminated such that light is emitted from the LED illumination panel and through the front panel;

a first opening formed in the front panel;

a second opening formed in the LED illumination panel, the second opening having a size, shape, and location corresponding to the first opening;

wherein the surround is mounted to a first side of a wall such that the front panel is disposed adjacent the wall and is generally parallel to the wall;

wherein an ATM is installed on a second side of the wall; and wherein the ATM has a customer interface, the ATM customer interface allowing a customer to complete banking transactions and to withdraw cash from the ATM, wherein the ATM customer interface extends through the wall, and wherein the ATM customer interface extends through the first opening and the second opening such that the ATM customer interface extends in front of the front panel and such that the LED illumination panel and the front panel extend laterally around the ATM customer interface.

13. The surround of claim 12, further comprising a graphic element applied to the front panel.

14. The surround of claim 12, wherein the LED illumination panel comprises LEDs mounted to the outer edges of the LED illumination panel, such that the LEDs emit light into the edge of the LED illumination panel towards the center of the panel and wherein the LED illumination panel redirects the light from the LEDs out a front face of the LED illumination panel.

15. An illuminated ATM surround system comprising:

an LED illumination panel;

a graphic display element attached in front of the LED illumination panel;

wherein the LED illumination panel is illuminated such that light is emitted from a front of the LED illumination panel and such that the light passes through the graphic display element to illuminate the graphic display element;

a first opening formed in a center portion of the graphic display;

a second opening formed in a center portion of the LED illumination panel, the second opening being aligned with the first opening;

wherein the ATM surround is mounted to a first side of a wall such that the surround is disposed adjacent the wall and is generally parallel to the wall, and such that the first opening and second opening are aligned with an opening in the wall;

wherein a bank ATM is installed on a second side of the wall; and wherein the bank ATM has a customer interface which allows a customer to complete banking transactions with the bank and to withdraw cash from the ATM, wherein the ATM customer interface extends through the opening in the wall, and wherein the ATM customer interface extends through the first opening and the second opening such that the ATM customer interface extends from the wall beyond the graphic display and such that the LED illumination panel extends around the ATM customer interface.

16. The surround of claim 15, wherein the graphic display comprises a front panel which is formed from a translucent or transparent material which allows light to pass through the front panel.

17. The surround of claim 15, wherein the LED illumination panel comprises LEDs mounted to the outer edges of the LED illumination panel, such that the LEDs emit light into the edge of the LED illumination panel towards the center of the LED illumination panel and wherein the LED illumination panel redirects the light from the LEDs out a front face of the LED illumination panel.

18. An method for presenting an illuminated ATM surround comprising:

selecting a bank ATM which is installed on a wall, the wall having a first and a second side, wherein the ATM is located on the second side of the wall, wherein the ATM has a customer interface which allows a customer to complete banking transactions with the bank and to withdraw cash from the ATM, and wherein the ATM customer interface extends through an opening in the wall to the first side of the wall and is accessed from the first side of the wall;

selecting an illuminated ATM surround comprising:

an LED illumination panel;

a graphic display element attached in front of the LED illumination panel;

a first opening formed in a center portion of the graphic display;

a second opening formed in a center portion of the LED illumination panel, the second opening being aligned with the first opening;

maintaining the ATM surround on the wall such that the ATM surround is mounted to the first side of a wall, such that the surround is disposed adjacent the wall and is generally parallel to the wall, and such that the first opening and second opening are aligned with the opening in the wall;

wherein the ATM customer interface extends through the first opening and the second opening such that the ATM customer interface extends from the wall beyond the graphic display and such that the LED illumination panel extends around the ATM customer interface; and operating the ATM surround to illuminate the LED illumination panel wherein the LED illumination panel is illuminated such that light is emitted from a front of the LED illumination panel and such that the light passes through the graphic display element to illuminate the graphic display element.

19. The surround of claim 18, wherein the graphic display comprises a front panel which is formed from a translucent or transparent material which allows light to pass through the front panel.

20. The surround of claim 18, wherein the LED illumination panel comprises LEDs mounted to the outer edges of the LED illumination panel, such that the LEDs emit light into the edge of the LED illumination panel towards the center of the LED illumination panel and wherein the LED illumination panel redirects the light from the LEDs out a front face of the LED illumination panel.

* * * * *